US009648426B2

(12) United States Patent
Akino

(10) Patent No.: US 9,648,426 B2
(45) Date of Patent: May 9, 2017

(54) UNIDIRECTIONAL CONDENSER MICROPHONE UNIT

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 14/567,585

(22) Filed: Dec. 11, 2014

(65) Prior Publication Data

US 2015/0189417 A1 Jul. 2, 2015

(30) Foreign Application Priority Data

Dec. 26, 2013 (JP) ..... 2013-268351

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl.
CPC ..... *H04R 19/04* (2013.01)

(58) Field of Classification Search
CPC ..... H04R 19/04
USPC ..... 381/356
See application file for complete search history.

(56) References Cited

U.S. PATENT DOCUMENTS

2004/0125975 A1* 7/2004 Suzuki ..... H04R 1/38 381/369
2010/0189298 A1* 7/2010 Akino ..... H04M 1/035 381/356
2010/0329483 A1* 12/2010 Akino ..... H04R 19/04 381/111
2013/0216084 A1* 8/2013 Akino ..... H04R 1/326 381/346

FOREIGN PATENT DOCUMENTS

JP 2011-009807 A 1/2011

* cited by examiner

*Primary Examiner* — Duc Nguyen
*Assistant Examiner* — Sean H Nguyen
(74) *Attorney, Agent, or Firm* — Manabu Kanesaka

(57) ABSTRACT

An acoustic impedance on a rear acoustic terminal side is set such that satisfactory directionality is obtained even in a high tone range. A rear portion of a sealing member 30A fitted to a unit case 10 is formed in a convex spherical shape, ranging from an apex part 301 to a hem part 302. The sealing member 30A forms an acoustic distributed constant circuit including: a first portion 310 in which a cross-sectional area of a sound path continuously increases, the sound path running from acoustic resistance parts AR as sound holes 28*a* of an electroacoustic transducer 20 to reach a rear acoustic terminal 12 through an air chamber A; and a second portion 320 on the rear acoustic terminal 12 side in which a cross-sectional area continuously decreases toward a direction farther from a sound pickup source.

5 Claims, 4 Drawing Sheets

UNIDIRECTIONAL CONDENSER MICROPHONE UNIT

CROSS-REFERENCE TO RELATED APPLICATION

The present application is based on, and claims priority from, Japanese Application Serial Number JP2013-268351, filed Dec. 26, 2013, the disclosure of which is hereby incorporated by reference herein in its entirety.

TECHNICAL FIELD

The present invention relates to a unidirectional condenser microphone unit, and, more specifically, to a technique of setting an acoustic impedance on a rear acoustic terminal side so as to obtain satisfactory directionality even in a high tone range.

BACKGROUND ART

In an end-address microphone (a rod-shaped microphone that picks up sound waves from its one end), a rear acoustic terminal is made by forming an opening in a peripheral wall portion of a cylindrical unit case. An example (see, for example, Japanese Patent Application Publication No. 2011-009807) of the conventional technique is described with reference to FIG. 4.

A unidirectional condenser microphone unit (hereinafter, simply referred to as "microphone unit" in some cases) 1B includes a cylindrical unit case 10 made of an aluminum material, a brass alloy, and the like.

The microphone is an end-address microphone, and hence one end (the left end in FIG. 4) of the unit case 10 is opened as a front acoustic terminal 11. An opening part as a rear acoustic terminal 12 for taking in velocity components is formed in a peripheral wall portion of the unit case 10 that is away by a predetermined distance from the front acoustic terminal 11.

Note that a lock part 10*a* bent inward is formed in an opening part of the front acoustic terminal 11. A female screw 10*b* is formed at another end (rear end) of the unit case 10. Moreover, in this example, a guard net 11*a* made of a wire net or the like is attached to the opening part of the front acoustic terminal 11.

Normally, some linear protrusions or grid-like rails 12*a* are provided in the opening part of the rear acoustic terminal 12, mainly from the viewpoint of designing. A dust-proof guard net 12*b* made of, for example, a wire net is placed on the inner side of the rails 12*a*.

The microphone unit 1B includes an electrostatic type electroacoustic transducer 20 in which a diaphragm 21 and a fixed pole 24 are opposedly placed with the intermediation of an electrically insulating spacer ring 23, the diaphragm 21 being stretched on a support ring (diaphragm ring) 22 at a predetermined tension, the fixed pole 24 being supported by an electrically insulating seating 25 made of, for example, synthetic resin.

A plurality of sound holes (holes for allowing sound waves to pass therethrough) 25*a* are pierced in the insulating seating 25. Although not illustrated in detail, the fixed pole 24 is made of a porous plate, and includes a plurality of sound holes. In this example, an acoustic resistance material 26 made of a felt material and the like is placed between the fixed pole 24 and the insulating seating 25.

The electroacoustic transducer 20 is housed between the front acoustic terminal 11 and the rear acoustic terminal 12 in the unit case 10. A sealing member 30 is fitted to the another end (rear end) of the unit case 10. As a result, an air chamber A having a predetermined volume for obtaining non-directional components is formed on the back surface side of the insulating seating 25. In this example, a cylindrical member whose apex part that faces the insulating seating 25 is formed in a truncated conical shape is used as the sealing member 30.

A sealing substrate 40 is attached to the rear end of the sealing member 30, and a lock ring 50 is screwed into the female screw 10*b* formed at the another end of the unit case 10. As a result, the electroacoustic transducer 20 is fixed in the unit case 10 by the sealing substrate 40 and the sealing member 30 while abutting against the lock part 10*a*.

Note that an electrode draw-out terminal 27 of the fixed pole 24 is drawn out from a central portion of the insulating seating 25. A relay terminal 31 in fitting contact with the electrode draw-out terminal 27 is provided in the central portion of the sealing member 30 so as to penetrate through the sealing substrate 40.

Moreover, the microphone unit 1B is coupled to a cylindrical microphone grip (microphone main body) (not illustrated) with the intermediation of, for example, the female screw 10*b*, and the relay terminal 31 is electrically connected to a circuit board including a speech signal output circuit housed in the microphone grip.

In the microphone unit 1B, sound waves that have entered the microphone unit 1B from the rear acoustic terminal 12 act as velocity components on the back surface of the diaphragm 21 through the air chamber A, the sound holes 25*a* of the insulating seating 25, the acoustic resistance material 26, and the sound holes (not illustrated) of the fixed pole 24. As a result, the microphone unit 1B operates in a unidirectional manner.

Meanwhile, microphone units are generally designed on the basis of lumped constant equivalent circuits, assuming planar waves. In the case of a high frequency of around 10 kHz, however, acoustic elements approach the wavelengths of sound waves, and hence the lumped constant equivalent circuits are insufficient.

At a frequency at which a half wavelength ½λ, of a sound wave is equal to the distance between the acoustic terminals of the electroacoustic transducer 20, a sound pressure gradient between the front acoustic terminal 11 and the rear acoustic terminal 12 disappears. Hence, the drive force of the diaphragm 21 based on the sound pressure gradient cannot be generated. For these reasons, the directionality in a high tone range of the unidirectionality (polar pattern, cardioid) deteriorates.

Moreover, portions of the sound holes 25*a* of the insulating seating 25 are defined as acoustic resistance parts AR behind the fixed pole, and a sound path (sound wave path) running from the acoustic resistance parts AR to reach the rear acoustic terminal 12 is observed. In this case, in the above-mentioned conventional technique, because the apex part of the sealing member 30 that forms the air chamber A has the truncated conical shape, the cross-sectional area of the sound path rapidly changes when the sound path is viewed from the acoustic resistance parts AR side.

As a result, the sound path has an impedance containing reactance, the narrow portion operates as acoustic mass (represented by an inductance L in an equivalent circuit), and the rapidly widened portion operates as acoustic capacitance (represented by a capacitance C in the equivalent circuit). Hence, resonance occurs in a given sound range, and a directional frequency response deteriorates.

In this way, in the microphone unit 1B according to the above-mentioned conventional technique, the sound path running from the acoustic resistance parts AR to reach the rear acoustic terminal 12 is discontinuous, and the rear acoustic terminal 12 is formed as a mere opening and does not have acoustic mass. For these reasons, as illustrated in a graph of a directional frequency response in FIG. 3B, the frequency response at 0 degrees has a peak around 7 kHz, and the frequency response at 180 degrees rises therearound, so that the directionality deteriorates.

In view of the above, the present invention has an object to set an acoustic impedance on a rear acoustic terminal side in a unidirectional condenser microphone so as to obtain satisfactory directionality even in a high tone range.

SUMMARY OF THE INVENTION

In order to achieve the above-mentioned object, the present invention provides a unidirectional condenser microphone unit including: a cylindrical unit case including: a front acoustic terminal in a front end portion of the unit case; and a rear acoustic terminal in a peripheral wall portion of the unit case that is away by a predetermined distance from the front acoustic terminal; an electrostatic type electroacoustic transducer including a diaphragm and a fixed pole that are opposedly placed with a predetermined distance therebetween, the electroacoustic transducer being housed between the front acoustic terminal and the rear acoustic terminal of the unit case; and a sealing member fitted to a rear end portion of the unit case, the sealing member forming an air chamber having a predetermined volume on a back surface side of the electroacoustic transducer. A velocity component taken in from the rear acoustic terminal acts on a back surface of the diaphragm through the air chamber and a sound hole included in the electroacoustic transducer. A portion of the sealing member is formed in a convex spherical shape, the portion ranging from an apex part adjacent to a central portion on the back surface side of the electroacoustic transducer to a hem part adjacent to the rear acoustic terminal. The rear acoustic terminal has a predetermined acoustic mass component. The sealing member forms an acoustic distributed constant circuit including: a first portion in which a cross-sectional area of a sound path continuously increases, the sound path running from an acoustic resistance part behind the fixed pole of the electroacoustic transducer to reach the rear acoustic terminal through the air chamber; and a second portion on the rear acoustic terminal side in which a cross-sectional area continuously decreases toward a direction farther from a sound pickup source.

Moreover, the acoustic resistance part is made of a sound hole, and it is preferable that $t1<\phi$ and $t2<\phi$, assuming that a diameter of the sound hole is $\phi$, that a distance between the electroacoustic transducer and the apex part of the sealing member is t1, and that a distance between the rear acoustic terminal and the hem part of the sealing member is t2.

Further, in the present invention, the first portion operates as an acoustic transducer, and the second portion adds acoustic mass to the rear acoustic terminal in a high tone range.

According to a preferable aspect of the present invention, the rear acoustic terminal includes a plurality of slits, given slits of the plurality of slits are defined as one group, the given slits being formed on the same circumference in the peripheral wall portion of the unit case, a plurality of the groups are placed at predetermined intervals along an axial direction of the unit case, and a volume in each of the plurality of slits adds a predetermined acoustic mass component to the rear acoustic terminal.

According to another aspect of the present invention, the sealing member is made of a sound insulating material having electrically insulating properties, and an electrode draw-out terminal of the fixed pole penetrates through a central portion of the sealing member.

According to the present invention, the sealing member forms the acoustic distributed constant circuit including: the first portion in which the cross-sectional area of the sound path continuously increases, the sound path running from the acoustic resistance part behind the fixed pole of the electroacoustic transducer to reach the rear acoustic terminal through the air chamber; and the second portion on the rear acoustic terminal side in which the cross-sectional area continuously decreases toward the direction farther from the sound pickup source. The first portion of these portions operates as a horn-speaker-like acoustic transducer. This can prevent discontinuous connection between the acoustic impedance with a high acoustic resistance and the air impedance in free space.

Moreover, the rear acoustic terminal has acoustic mass, and the second portion on the rear acoustic terminal side in which the cross-sectional area continuously decreases toward the direction farther from the sound pickup source adds acoustic mass to the rear acoustic terminal in the high tone range. Hence, entrance of sound waves into the rear acoustic terminal is restricted in the high tone range. This can prevent a decrease in diaphragm drive force at a frequency at which a half wavelength $\frac{1}{2}\lambda$ of a sound wave is equal to the distance between the acoustic terminals of the electroacoustic transducer. Moreover, the acoustic mass on the rear acoustic terminal side increases with distance from the sound pickup source. Hence, resonance with an acoustic capacitance existing in the air chamber for obtaining non-directional components is reduced.

DETAILED DESCRIPTION

Next, an embodiment of the present invention is described with reference to FIG. 1 to FIG. 3, and the present invention is not limited to the embodiment. Note that, in describing the present embodiment, substantially the same components as those in the microphone unit 1B according to the conventional technique that is described in BACKGROUND ART with reference to FIG. 4 are denoted by the same reference signs as those in the microphone unit 1B.

Figure 1A:
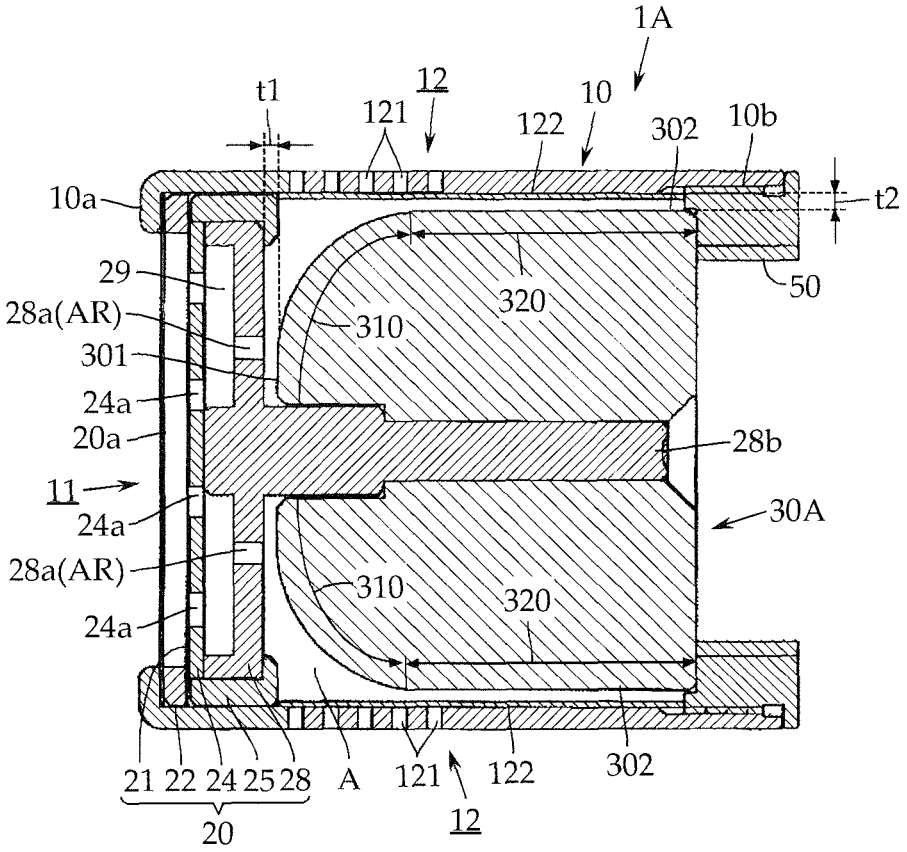
FIG. 1A is a schematic cross-sectional view illustrating a unidirectional condenser microphone unit according to an embodiment of the present invention.
Figure 2A:
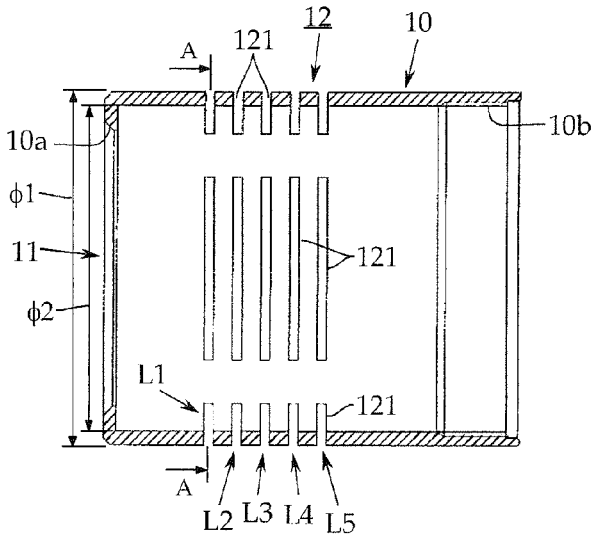
FIG. 2A is a longitudinal sectional view illustrating a unit case according to the embodiment.
Figure 2B:
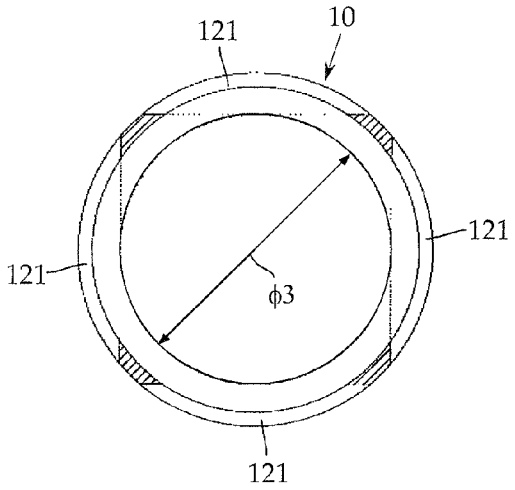
FIG. 2B is a cross-sectional view taken along a line A-A in FIG. 2A.

With reference to FIG. 1A, a unidirectional condenser microphone unit (hereinafter, simply referred to as "microphone unit" in some cases) 1A according to the present embodiment includes, as a basic configuration, a unit case 10, an electrostatic type electroacoustic transducer 20, and a sealing member 30A.

The unit case 10 is a cylindrical member made of an electrically conductive material such as aluminum and a brass alloy, and one end (the left end in FIG. 1) thereof is opened as a front acoustic terminal 11. Similarly to the conventional technique, a lock part 10*a* bent inward is formed in the opening part of the unit case 10. Moreover, a female screw 10*b* with which a lock ring 50 is to be engaged is formed at another end (rear end) of the unit case 10.

A rear acoustic terminal 12 for taking in velocity components is provided in a peripheral wall portion of the unit case 10 that is away by a predetermined distance from the front acoustic terminal 11. In the present embodiment, the rear acoustic terminal 12 includes a plurality of slits 121. The slits 121 enable the rear acoustic terminal 12 to have predetermined acoustic mass (acoustic mass represented by an inductance L in an equivalent circuit).

A specific configuration of the slits 121 in the present embodiment is described with reference to FIGS. 2A and 2B. The unit case 10 has an outer diameter $\phi 1$ of 19 mm and an inner diameter $\phi 2$ of 17.52 mm, and hence the thickness of the unit case 10 is about 0.75 mm. Four slits 121 each having a width of 0.5 mm and a length of 12 mm, which are defined as one group, are formed at 90-degree intervals on the same circumference of the cylindrical wall of the unit case 10, and such slit groups are placed at 1.2-millimeter pitches in five lines (L1 to L5), whereby the rear acoustic terminal 12 is formed.

As illustrated in FIG. 1A, an acoustic resistance material 122 is placed on the inner surface of the unit case 10 so as to cover the rear acoustic terminal 12. In the present embodiment, a 325-mesh stainless-steel net having a wire diameter of 0.035 mm is used as the acoustic resistance material 122.

Figure 1B:
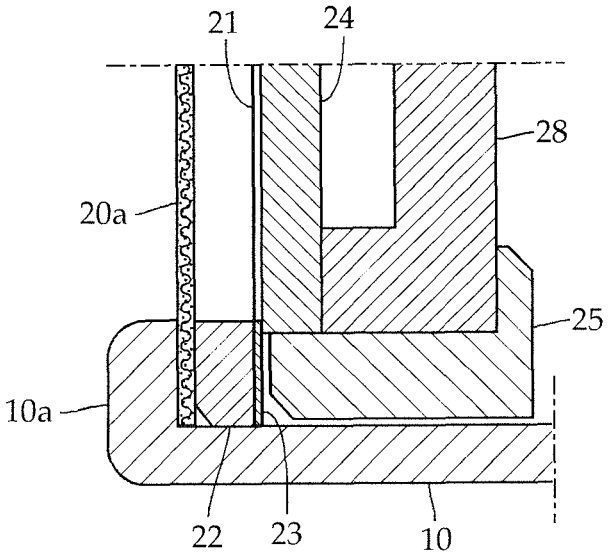
FIG. 1B is a cross-sectional view illustrating, in an enlarged manner, part of an electroacoustic transducer included in the condenser microphone unit in FIG. 1A.

Also with reference to FIG. 1B, in the electroacoustic transducer 20, a diaphragm 21 and a fixed pole 24 are opposedly placed with the intermediation of a spacer ring 23, the diaphragm 21 being stretched on a support ring (diaphragm ring) 22 at a predetermined tension, the fixed pole 24 being supported by an electrically insulating seating 25 made of, for example, synthetic resin. In the present embodiment, the insulating seating 25 is formed as a cylindrical holder, an electrode draw-out member 28 for the fixed pole is placed on the rear side of the fixed pole 24, and the fixed pole 24 and the electrode draw-out member 28 are housed in the unit case 10 while being supported in the insulating seating 25.

The fixed pole 24 is made of a metal porous plate, and includes a plurality of sound holes (holes for allowing sound waves to pass therethrough) 24*a*. An electret dielectric film may be integrally joined to the fixed pole 24, whereby the microphone unit 1A may be configured into electret type.

Similarly to the insulating seating 25 in the microphone unit 1B according to the conventional technique described in BACKGROUND ART, the electrode draw-out member 28 for the fixed pole is formed in a dish-like shape, and a plurality of sound holes 28*a* are pierced in the electrode draw-out member 28. The sound holes 28*a* correspond to the sound holes 25*a* that are pierced in the insulating seating 25 in the microphone unit 1B according to the conventional technique.

The electrode draw-out member 28 is provided with a concave part 29 for forming an air chamber on the rear surface side of the fixed pole 24. An acoustic resistance material made of a felt material and the like may be placed in the concave part 29. Moreover, an electrode draw-out terminal 28*b* is integrally provided in a protruding manner to a central portion of the electrode draw-out member 28, the electrode draw-out terminal 28*b* corresponding to the electrode draw-out terminal 27 of the fixed pole 24 in the microphone unit 1B according to the conventional technique.

The sealing member 30A is fitted into the unit case 10 from the another end (rear end) of the unit case 10. As a result, an air chamber A having a predetermined volume for obtaining non-directional components is formed on the back surface side of the electroacoustic transducer 20.

The sealing member 30A is made of a sound insulating material having electrically insulating properties, such as a synthetic resin material and a ceramic material. The electrode draw-out terminal 28*b* of the electrode draw-out member 28 for obtaining speech signals from the fixed pole 24 penetrates through a central portion of the sealing member 30A.

The lock ring 50 is engaged with and screwed into the female screw 10*b* formed at the another end of the unit case 10, whereby the electroacoustic transducer 20 is fixed in the unit case 10 by the sealing member 30A while abutting against the lock part 10*a*.

Note that the electroacoustic transducer 20 may be fixed by swaging the unit case 10, instead of using the lock ring 50. Moreover, as illustrated in FIG. 1A, a guard net 20*a* made of a wire net or the like may be attached on the front surface side of the unit case 10.

Note that, similarly to the microphone unit 1B according to the conventional technique described in BACKGROUND ART, the microphone unit 1A is coupled to a cylindrical microphone grip (microphone main body) (not illustrated) with the intermediation of predetermined coupling means. The electrode draw-out terminal 28*b* is electrically connected to a circuit board including a speech signal output circuit housed in the microphone grip.

Also in the microphone unit 1A, sound waves that have entered the microphone unit 1A from the rear acoustic terminal 12 act as velocity components on the back surface of the diaphragm 21 through the air chamber A, the sound holes 28*a* of the electrode draw-out member 28, and the sound holes 24*a* of the fixed pole 24. As a result, the microphone unit 1A operates in a unidirectional manner.

In the present invention, in order to obtain satisfactory directionality even in a high tone range, as illustrated in FIG. 1A, a portion of the sealing member 30A is formed in a convex spherical shape, the portion ranging from an apex part 301 adjacent to a central portion of the electroacoustic transducer 20 (the central portion of the electrode draw-out member 28) to a hem part 302 adjacent to the rear acoustic terminal 12.

The sealing member 30A having such a special shape as described above forms an acoustic distributed constant circuit including a first portion 310 and a second portion 320. Specifically, portions of the sound holes 28*a* of the electrode draw-out member 28 are defined as acoustic resistance parts AR behind the fixed pole. Then, in the first portion 310, the cross-sectional area of a sound path (sound wave path) continuously increases, the sound path running from the acoustic resistance parts AR to reach the rear acoustic terminal 12 through the air chamber A. Further, in the second portion 320 on the rear acoustic terminal 12 side, the cross-sectional area continuously decreases toward a direction farther from a sound pickup source (a sound pickup source existing in front of the front acoustic terminal 11).

In the present embodiment, the first portion 310 forms a main part of the convex spherical shape, and the second portion 320 continuous therewith has a gentle conical shape.

According to the present invention, a horn-speaker-like acoustic transducer is formed by the first portion 310 in which the cross-sectional area of the sound path running from the acoustic resistance parts AR to reach the rear acoustic terminal 12 through the air chamber A continuously increases. This can prevent discontinuous connection between the acoustic impedance with a high acoustic resistance in the air chamber A and the air impedance in free space.

Moreover, in the present invention, the rear acoustic terminal 12 has predetermined acoustic mass (inductance component L) as described above. Hence, as the tone range becomes a high tone range of around 10 kHz or higher, the acoustic resistance of the rear acoustic terminal 12 becomes higher, and entrance of sound waves into the rear acoustic terminal 12 is more restricted. This can prevent a decrease in diaphragm drive force at a frequency at which a half wavelength ½λ of a sound wave is equal to the distance between the acoustic terminals.

Unfortunately, if the rear acoustic terminal 12 has the acoustic mass (inductance component L), the acoustic mass may resonate with the acoustic capacitance (capacitance component C) based on the volume existing in the sound path in the first portion 310.

To avoid this, in the present invention, the second portion 320 in which the cross-sectional area continuously decreases toward the direction farther from the sound pickup source is provided on the rear acoustic terminal 12 side. Acoustic mass added to the rear acoustic terminal 12 is increased by the second portion 320, whereby the above-mentioned resonance is reduced.

Note that, assuming that the diameter of each of the sound holes 28*a* of the electrode draw-out member 28 as the acoustic resistance parts AR behind the fixed pole is $\phi a$, that the distance between the electrode draw-out member 28 and the apex part 301 of the sealing member 30A is t1, and that the distance between the rear acoustic terminal 12 and the hem part 302 of the sealing member 30A is t2, it is preferable that $t1<\phi a$ and that $t2<\phi a$, in order to obtain satisfactory directionality even in the high tone range.

In the present embodiment, because the diameter $\phi a$ of each of the sound holes 28*a* of the electrode draw-out member 28 is 1 mm, both the distances t1 and t2 are set to 0.5 mm, but may be smaller than 0.5 mm.

Moreover, the convex spherical shape of the first portion 310 may be determined as appropriate in accordance with specifications of the microphone unit 1A. In the present embodiment, the curvature of the convex spherical shape thereof is R5, and a cross-sectional diameter $\phi 3$ taken in the first line L1 that is one of pass points of the convex spherical shape is set to 14.5 mm as illustrated in FIG. 2B.

Figure 3A:
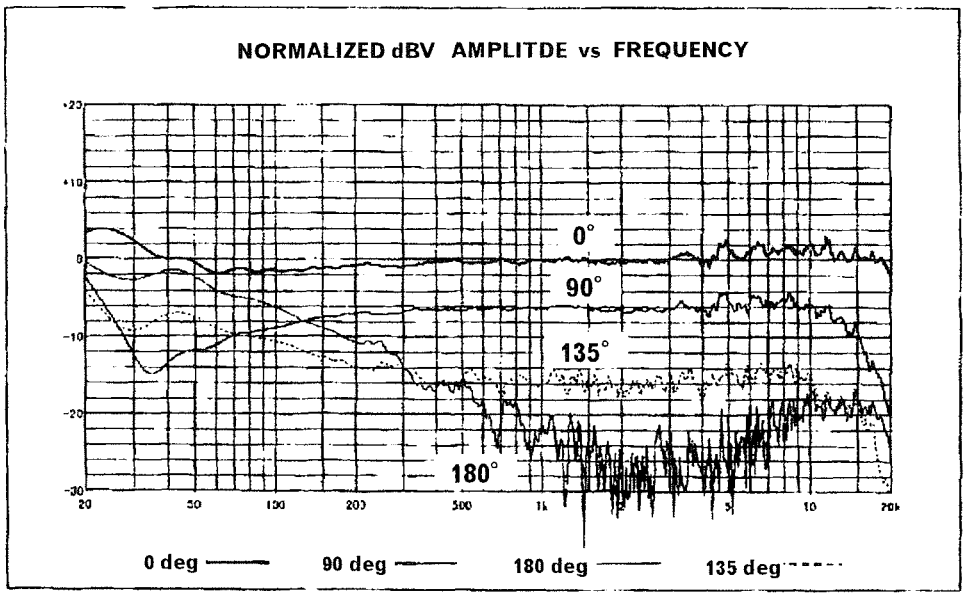
FIG. 3A is a graph illustrating a directional frequency response of the unidirectional condenser microphone unit according to the embodiment.
Figure 3B:
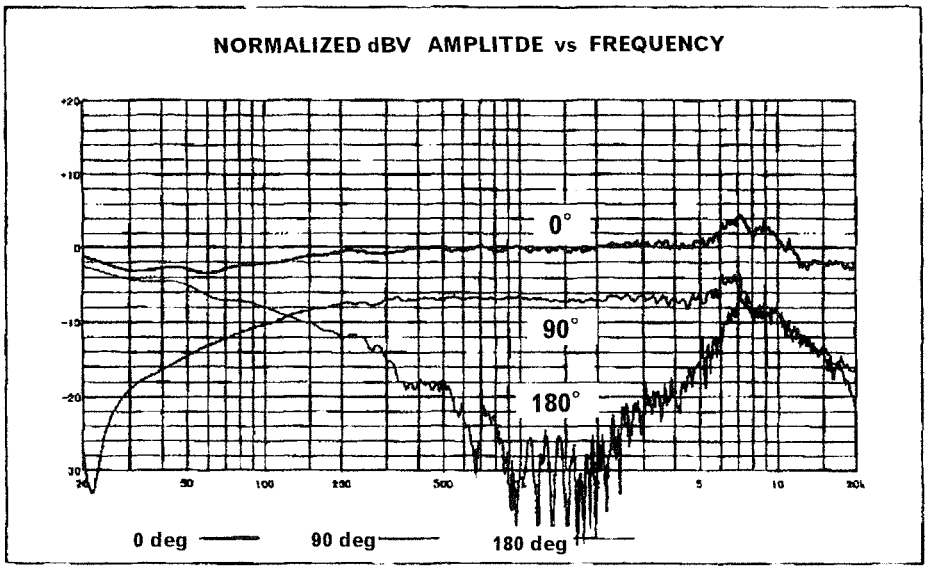
FIG. 3B is a graph illustrating a directional frequency response of a unidirectional condenser microphone unit according to a conventional technique.
Figure 4:
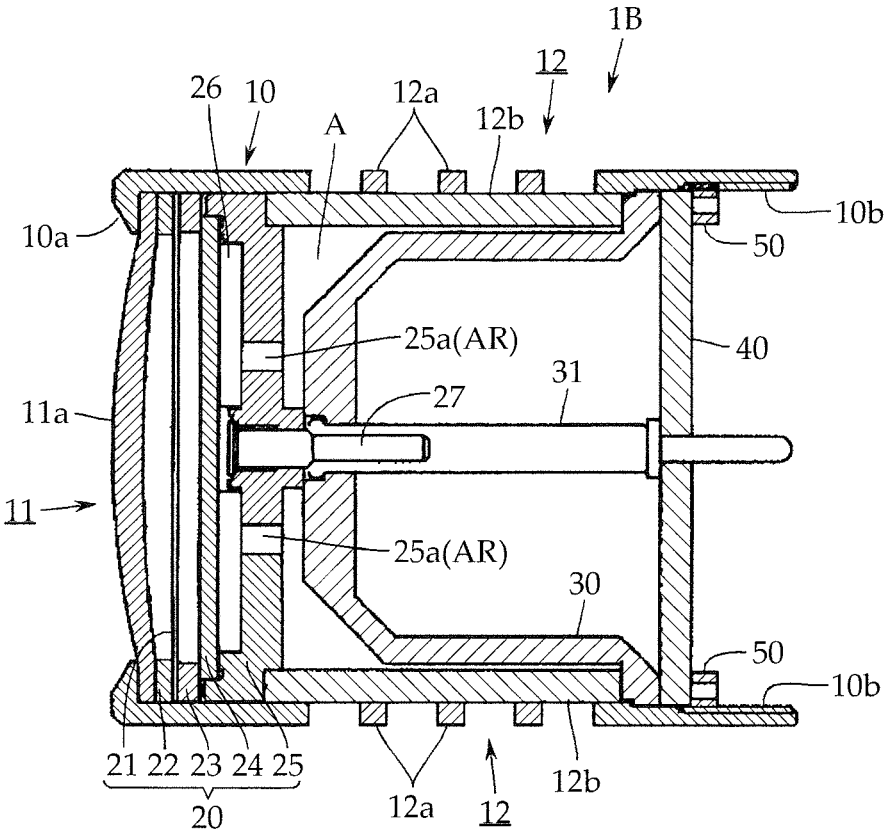
FIG. 4 is a schematic cross-sectional view illustrating the unidirectional condenser microphone unit according to the conventional technique.

FIG. 3A is a graph illustrating a directional frequency response of the microphone unit 1A according to the embodiment. As is apparent from this graph, the frequency responses at 0 degrees and 180 degrees are flat, and satisfactory directionality is achieved even in a frequency range of above 10 kHz.

Note that the sealing member 30A is illustrated as a solid member in FIG. 1, but may be a hollow member whose inside is hollowed out. Moreover, some of the slits 121 included in the rear acoustic terminal 12 may be formed parallel along the axial direction of the unit case 10, and the rear acoustic terminal 12 may be formed of a large number of round holes having acoustic mass.

Moreover, similarly to the electroacoustic transducer 20 included in the microphone unit 1B according to the conventional technique, a dish-like insulating seating 25 may be placed on the back surface side of the fixed pole 24 in the electroacoustic transducer 20.

The invention claimed is:

1. A unidirectional condenser microphone unit comprising:

a cylindrical unit case including: a front acoustic terminal disposed in a front end portion of the unit case; and a rear acoustic terminal disposed in a peripheral wall portion of the unit case that is away by a predetermined distance from the front acoustic terminal;

an electrostatic type electroacoustic transducer including a diaphragm, a fixed pole, and a sound hole, the diaphragm and the fixed pole being opposedly placed with a predetermined distance therebetween, the electroacoustic transducer being housed between the front acoustic terminal and the rear acoustic terminal of the unit case; and a sealing member fitted to a rear end portion of the unit case, the sealing member forming an air chamber having a predetermined volume on a back surface side of the electroacoustic transducer, wherein the rear acoustic terminal is structured to take in a velocity component acting on a back surface of the diaphragm through the air chamber and the sound hole in the electroacoustic transducer, the sealing member includes a portion in a convex spherical shape, the portion ranging from an apex part adjacent to a central portion on the back surface side of the electroacoustic transducer to a hem part adjacent to the rear acoustic terminal in order to obtain satisfactory directionality even in a high tone range, the rear acoustic terminal has a predetermined acoustic mass component, the sealing member forms an acoustic distributed constant circuit including:

a first portion as an acoustic transducer in which a cross-sectional area of a sound path continuously increases, the sound path running from an acoustic resistance part behind the fixed pole of the electroacoustic transducer to reach the rear acoustic terminal through the air chamber, wherein the first portion of the acoustic transducer prevents discontinuous connection between an acoustic impedance with a high acoustic resistance in the air chamber and an air impedance in a free space; and a second portion on a rear acoustic terminal side for adding an acoustic mass to the rear acoustic terminal in a high tone range in which the cross-sectional area of the sound path continuously decreases toward a direction farther from a sound pickup source, wherein the second portion adding the acoustic mass to the rear acoustic terminal prevents resonance with an acoustic capacitance based on a volume existing in the sound path in the first portion, the acoustic resistance part is made of the sound hole, and $t1<\phi$ and $t2<\phi$, assuming that a diameter of the sound hole is $\phi$, that a distance between the electroacoustic transducer and the apex part of the sealing member is t1, and that a distance between the rear acoustic terminal and the hem part of the sealing member is t2.

2. The unidirectional condenser microphone unit according to claim 1, wherein the rear acoustic terminal includes a plurality of slits, defined as one group, arranged on a same circumference in the peripheral wall portion of the unit case, a plurality of groups of slits, each being arranged on the same circumference, is placed at predetermined intervals along an axial direction of the unit case, and a volume in each of the plurality of slits adds the predetermined acoustic mass component to the rear acoustic terminal.

3. The unidirectional condenser microphone unit according to claim 1, wherein the sealing member is made of a sound insulating material having electrically insulating properties, and an electrode draw-out terminal of the fixed pole penetrates through a central portion of the sealing member.

4. The unidirectional condenser microphone unit according to claim 3, further comprising a lock ring fixed to the rear end portion of the unit case to engage the sealing member, wherein the sound path extends from the acoustic resistance part behind the fixed pole of the electroacoustic transducer to the lock ring.

5. The unidirectional condenser microphone unit according to claim 4, wherein the electroacoustic transducer further comprises:

a draw-out member arranged on a back side of the fixed pole and having the acoustic resistance part, and integrally formed with the draw-out terminal at the central portion thereof penetrating through the sealing member, and an electrically insulating seating supporting a circumferential surface of the fixed pole, a circumferential surface of the draw-out member, and a rear surface of the draw-out member.

* * * * *